United States Patent [19]

Mayer et al.

[11] Patent Number: 4,462,340

[45] Date of Patent: Jul. 31, 1984

[54] ARRANGEMENT FOR PREVENTING THE FORMATION OF CRACKS ON THE INSIDE SURFACES OF FEEDWATER LINE NOZZLES OPENING INTO PRESSURE VESSELS

[75] Inventors: Hans Mayer, Bubenreuth; Zvonimir Sterk, Erlangen, both of Fed. Rep. of Germany

[73] Assignee: Kraftwerk Union Aktiengesellschaft, Mülheim, Fed. Rep. of Germany

[21] Appl. No.: 359,666

[22] PCT Filed: Jul. 21, 1981

[86] PCT No.: PCT/EP81/00103

§ 371 Date: Mar. 12, 1982

§ 102(e) Date: Mar. 12, 1982

[87] PCT Pub. No.: WO82/00330

PCT Pub. Date: Feb. 4, 1982

[30] Foreign Application Priority Data

Jul. 21, 1980 [DE] Fed. Rep. of Germany ..... 3027630

[51] Int. Cl.[3] ..... F22B 1/16

[52] U.S. Cl. ..... 122/34; 122/438; 122/504

[58] Field of Search ..... 122/504, 451 R, 406 B, 122/407, 34, 438

[56] References Cited

U.S. PATENT DOCUMENTS 3,661,123 5/1972 Romanos ..... 122/34

FOREIGN PATENT DOCUMENTS 2210273 7/1974 France .

*Primary Examiner*—Edward G. Favors

*Attorney, Agent, or Firm*—Herbert L. Lerner; Laurence A. Greenberg

[57] ABSTRACT

Arrangement for the prevention of crack formations at the inside surfaces of feedwater line nozzles (13) which open into pressure vessels, especially nuclear reactor pressure vessels or steam generators. The feedwater is introduced into the water/steam space (II) of the pressure vessel (DE) via a substantially horizontal line section (140) and a rising line section (141) following downstream thereof up to the overflow edges Ü at the end of the flow travel of the rising line section (141). From there, the feedwater is admixed to the medium in the water/steam space (II) or the descent space (8) of the pressure vessel (DE) via a downward-directed line section (141) and optionally, via a ring feedline (12) connected thereto. This prevents temperature stratification due to backflow of warmer water in the nozzle. It is important here to make the ratio $A_n/D_i$ as small as possible. In practice it has been found to be feasible to provide a ratio which is approximately within the limits 0.5 and 2. ($A_n$) here refers to the horizontal distance of the pressure vessel inside wall from the center line ($M_{ii}$) going through the center of gravity of that cross-sectional surface which is defined by the overflow edges (Ü). ($D_i$) refers to the inside diameter of the feedwater line opening into the pressure vessel.

4 Claims, 9 Drawing Figures

| FIG | $A_n$ | $D_i$ | $A_n/D_i$ |
|---|---|---|---|
| 2; 3 | $A_1 = 4,70$ | 3,70 | 1,27 |
| 4; 5 | $A_2 = 2,15$ | 3,55 | 0,61 |
| 6; 7 | $A_3 = 1,50$ | 2,50 | 0,60 |
| 8 | $A_4 = 5,20$ | 2,60 | 2,00 |

ARRANGEMENT FOR PREVENTING THE FORMATION OF CRACKS ON THE INSIDE SURFACES OF FEEDWATER LINE NOZZLES OPENING INTO PRESSURE VESSELS

The invention relates to an arrangement for preventing the formation of cracks at the inside surfaces of feedwater line nozzles which open into pressure vessels, particularly nuclear reactor pressure vessels or steam generators.

Such an arrangement is known for steam generators of nuclear reactors from German Published Non-Prosecuted Application 23 46 411.

If a cold medium is replenished to a system (vessel, pipeline) which is filled with a medium of elevated temperature, via a horizontal connection, i.e. a feedwater line nozzle, a stratification of colder and warmer medium comes about in the horizontal connecting piece, if the feeding takes place with a mass throughput which is small relative to the size of the connecting cross section. i.e. with low flow velocities. The same thing occurs if the medium is already present in the system to be fed in evaporated condition. The stratification comes about because the lighter (warmer) medium can flow back into the upper part of the flow cross section of the nozzle due to its buoyancy against the colder water to be fed-in. The temperature differences of the media lead to thermal stresses in the connecting nozzle or the connecting line which as a rule are already highly stressed by the internal pressure of the system, so that with a sufficiently large number of cycles of the feeding processes, material fatigue and thereby, the formation of cracks can occur. The phenomenon of temperature stratification could be demonstrated by temperature measurements on feedwater line nozzles of a steam generator for pressurized-water reactors.

In the known arrangement according to the German Published Non-Prosecuted Application mentioned at the outset, the feeding takes place with a flow conducted in the horizontal and/or downward-directed direction within the vessel. Although the feed nozzles are lined at their inner periphery with so-called thermosleeve tubes, the thermal stress problems mentioned at the outset can nevertheless still occur in subregions of the nozzles.

It is an object of the invention to develop the arrangement of the type mentioned at the outset in such a manner that for slow feeding of the feedwater line nozzle such as occurs under partial load or zero load operation of a plant, material fatigue and thereby, the crack formation at the nozzle are impossible with certainty, even with larger numbers of load changes of the feeding processes. According to the invention, the stated problem is solved by the feature that the feedwater is fed into the water/steam space of the pressure vessel through a substantially horizontal line section and a following rising line section up to the overflow edge at the end of the flow travel of the rising line section, from where the feedwater is admixed through a downwardly-directed line section, and optionally through a ring feedline connected thereto, with the medium in the water/steam space and in the descent space of the pressure vessel, so that temperature stratification due to flowback of warmer water in the nozzle is prevented. An advantageous further embodiment claim is that the line section which is substantially horizontal, is followed first, through a bend, by a substantially downwardly-directed line portion which leads into a collecting cup that has risisng flow paths up to the overflow edges. The advantages attainable with the invention are in particular that a reverse flow of the specifically lighter medium in the fed system against the heavier (still cold) medium still to be fed-in is prevented. Through the invention, not only all the problems of thermal stresses and crack formation which occur particularly under zero load and low load operation solved, but also those occurring during starting-up and shut-down operation.

In the following, the invention will be explained in greater detail with the aid of the drawing showing several embodiment examples, and the operation described. In schematic, simplified presentation, omitting the parts not required for an understanding of the invention, FIG. 1 is a longitudinal section of a steam generator for pressurized-water reactors with a feedwater line nozzle designed according to the invention;

Figure 1:
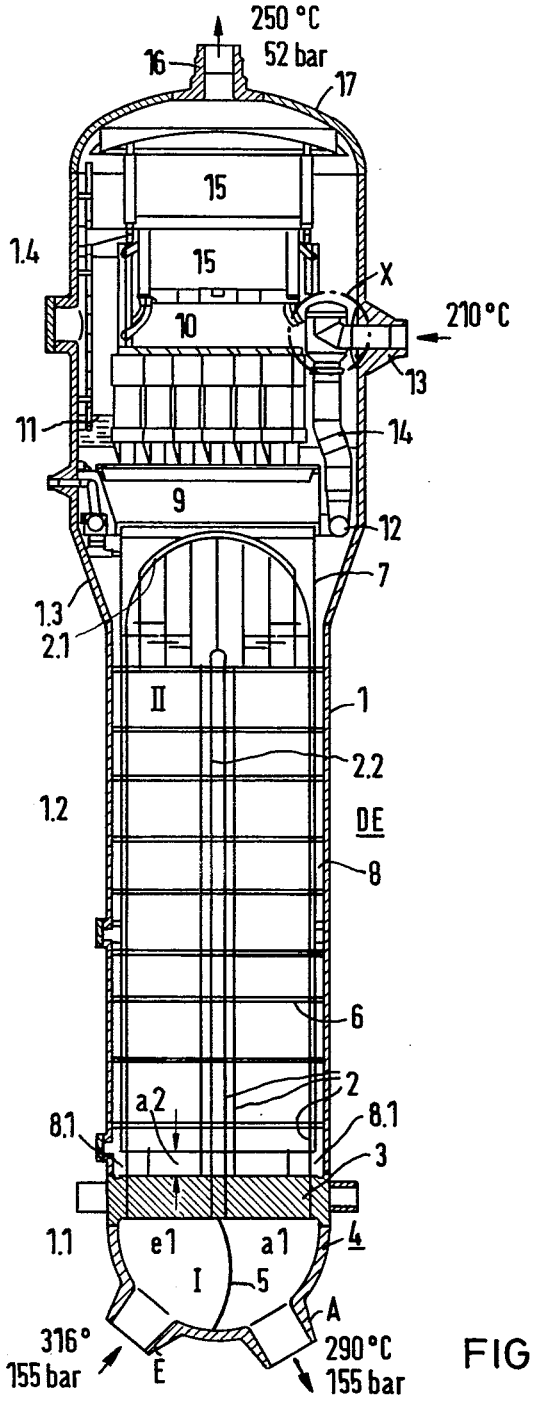

The steam generator DE for pressurized-water reactors according to FIG. 1 (called DE for short in the following) has a pressure vessel housing 1 with a primary chamber region 1.1, an evaporator region 1.2 which has the U-shaped heat-exchanger tubes 2, and a separating region 1.4 following via a conically expanding housing transition region 1.3. The tube sheet 3 welded into the housing 1 and the heat exchanger tubes 2 welded into it and held by it, gastightly separate the primary chamber I from the secondary chamber II. The primary chamber I is formed by a spherical bottom section 4 with inflow nozzle E and outflow nozzle A welded into the tube sheet 3, the inflow space el of the primary chamber being separated from the outflow space al by a dished partition 5. Of the tubes 2 of the tube bundle 2' only the outer and inner ones are indicated by lines; the tube bends are designated with reference numeral 2.1 and the innertube lane with 2.2. The primary medium (water) which is heated in the core of the pressurized-water reactor, not shown, is fed at a temperature of about 316° C. and with a pressure of 155 bar to the primary chamber I via the inlet nozzle E, flows through heat-exchanging tubes 2 and is fed back into the reactor pressure vessel via the outlet chamber a1 and the outlet nozzle A with a temperature of about 290° C.

The tube bundle of the heat-exchanging tubes 2 is held vibrationproof by means of tube holding grids 6 axially spaced from each other, it is surrounded by a hollow cylindrical jacket 7 which forms, together with the wall 1, an annular descent space 8. Since the jacket 7 is disposed at a distance a2 from the tube sheet 3, the descent space 8 is flow-wise in communication at its lower end with the evaporation space in the interior of the jacket 7 via the flow lanes 8.1. At its upper end, the jacket 7 is terminated by an extension 9 which carries at its top a battery of water separators 10 into which the water/steam mixture enters through suitable flow canals from the evaporation space II. The ejected water, (the water level of the circulating water is indicated at reference numeral 11) is fed back directly into the descent space 8. The ring line 12, which is arranged at the upper end of the descent space, serves, via openings not shown, for feeding the feedwater from a feedwater line nozzle 13 via an essentially vertical connecting line 14.

The largely dehydrated steam which leaves the water separators 10 at their top, then further flows into the steam purifier 15 and from there, via the live-steam nozzle 16 of the steam dome 17 to the steam turbines, not shown.

The steam generator works according to the natural circulation principle. The feedwater and the separated water flow mixed downward in the descent space 8 and into the evaporation space II and rise in the latter while being evaporated (wet steam). The water/steam mixture is then transported into the coarse separators 10 and finally into the steam purifiers 15 as already indicated. For introducing the feedwater via the nozzle 13 and the connecting pipe 14, entirely defined flow management is provided which will be explained with the aid of FIGS. 2 and 3.

The feedwater is introduced into the water/steam space of the steam generator via a substantially horizontal line section 140 and a line section 141 which follows downstream thereof and is designed as a pipe bend up to the overflow edges Ü at the end of the flow travel end of the rising section of the line 141. From there, the feedwater (see flow arrows f1) is admixed to the water/steam space via a downward-directed line section 142 and the feed ringline 12 connected thereto (FIG. 1), i.e. in this case to the descent space 8 of the steam generator. The line section 142 is of domelike shape and comprises the line portion 141 as a kind of bell. The line section 140 may be held in the nozzle 13 in the manner of a thermo sleeve tube (FIG. 1). Because of the line arrangement described, backflow of already heated feedwater into the line section 140 is no longer possible. Such a load state is also always present because the colder inflowing feedwater must fill the nozzle cross section completely due to its higher specific gravity before it reaches the higher-positioned overload edges Ü.

Figure 5:
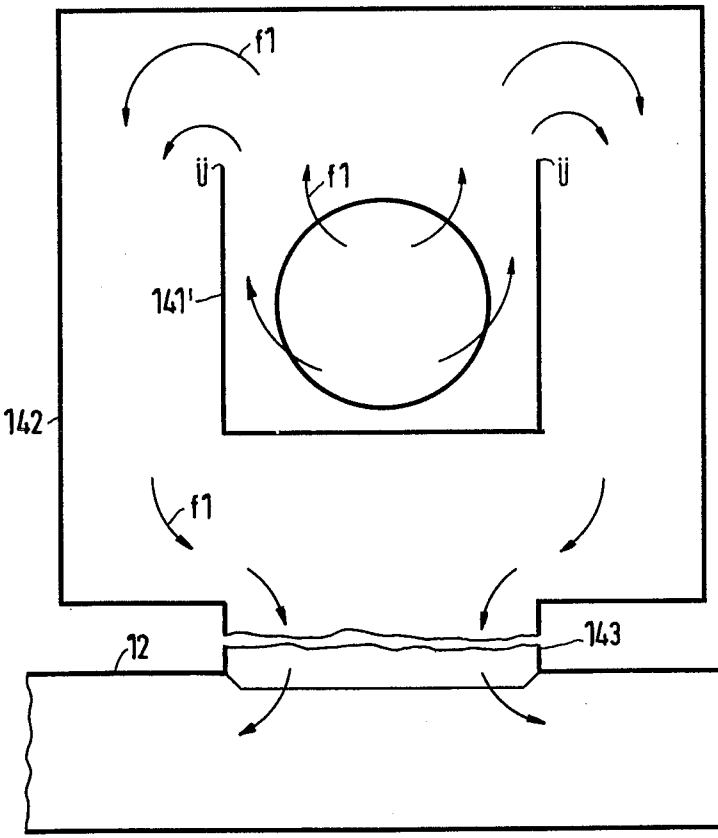
FIG. 5 is a fragmentary cross section according to the line V—V of FIG. 4.
Figure 4:
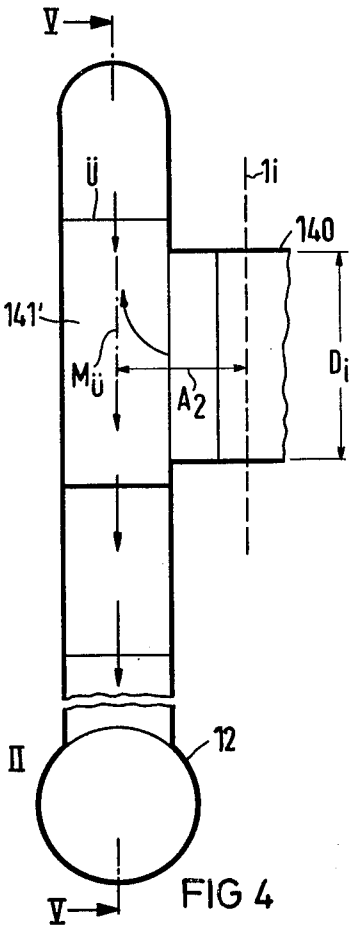
FIG. 4 is a presentation corresponding to FIG. 2 of, another embodiment of the arrangement which is constructed particularly low in the direction of the nozzle axis.

The low compact design according to FIGS. 4 and 5 is recommended for steam generators or reactor pressure vessels, in which only a little space is available in the direction of the nozzle axis. Like parts carry the same reference symbols. Here the rising line part is formed by a tray 141' of rectangular cross section which is flat and boxlike, and therefore forms a waterbox, at the two narrow top edges on which the overflow edges Ü are arranged. This water box 141' is surrounded by a likewise approximately boxlike structure 142 which is rounded at its top edge, for the downward-directed line section which may likewise be bent corresponding to the inside circumference curvature of the pressure vessel, and which leads at its lower end into the ring line 12 via a constricted neck piece 143.

Figure 7:
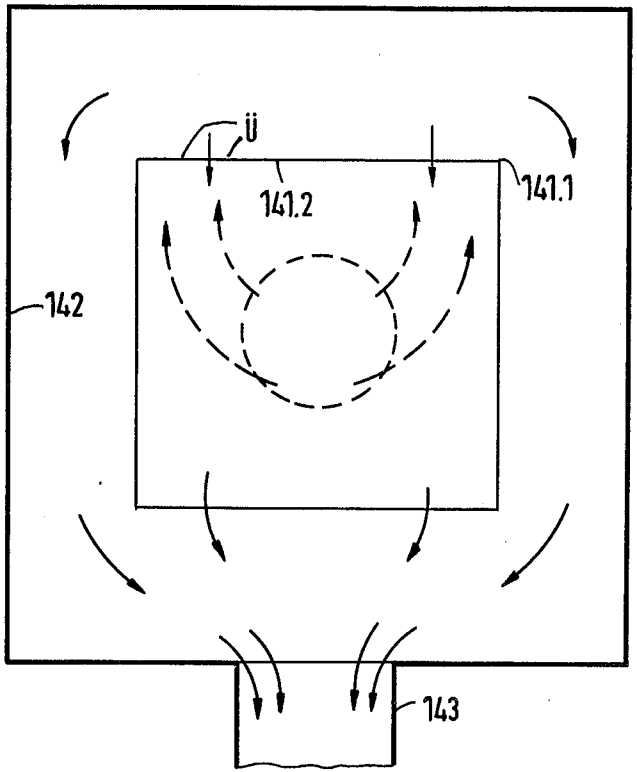
FIG. 7 is a fragmentary cross section according to line VII—VII of FIG. 6.
Figure 6:
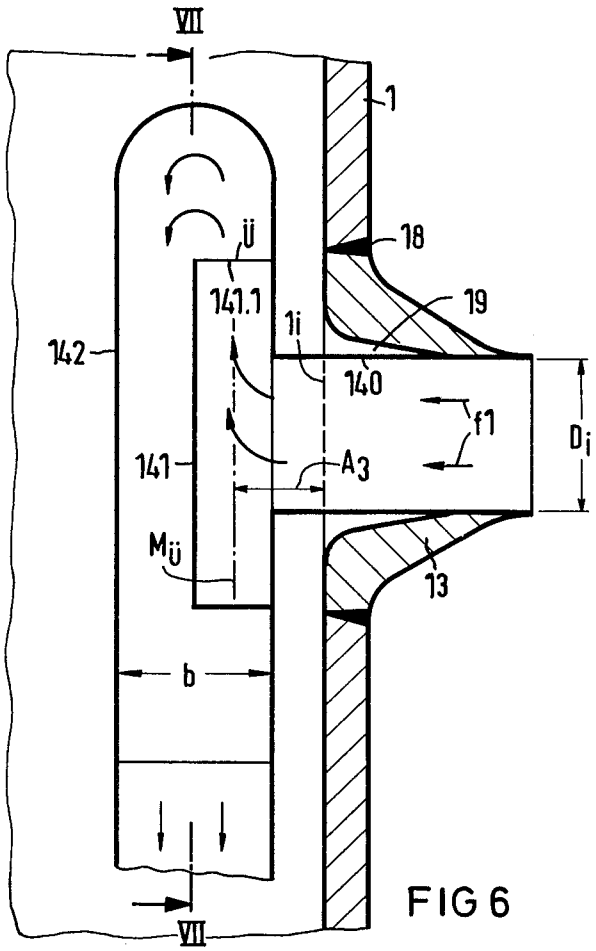
FIG. 6 is a fragmentary cross section of a further embodiment wherein part of the pressure vessel wall is also drawn, with particularly large flow cross section.

The arrangement according to FIGS. 6 and 7 is intended for a still larger feedwater throughput at full load. The overflow edges Ü are here not only the upper side edges 141.1, but also the edge 141.2 on the longitudinal side of the line section 141. Accordingly, the flow cross section of the downward-directed line section 142 is larger than in that according to FIGS. 4 and 5. It can furthermore be seen that the inside circumference of the feedwater line nozzle 13, which is welded into the housing wall of the steam generator by means of a circular welded seam 18, is lined with the line part 140 which is designed as a thermo sleeve pipe and is substantially horizontal. This thermo sleeve also may be a customary design or be designed in accordance with FIGS. 2 of German Published Non-Prosecuted Application 23 46 411.

Figures 8, 9:
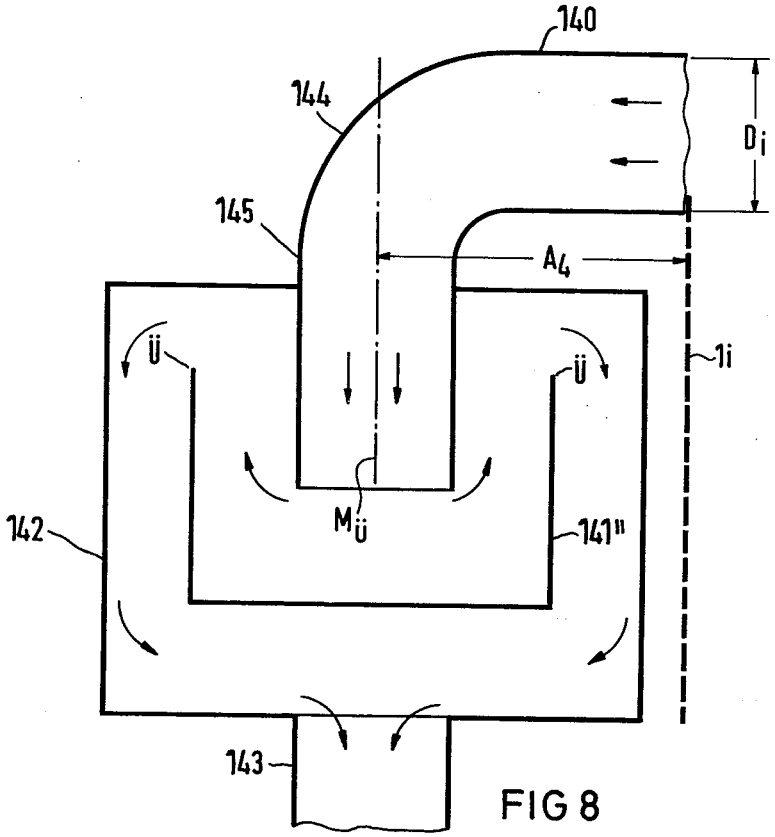
FIG. 8 is a fragmentary cross section of a fourth version with a downward leading feedline section and collecting cup.
FIG. 9 is a table of the variables $A_n$ and $D_i$.

In FIG. 8 it is further shown that a substantially horizontal line section 140 can be followed, after an elbow 144, first by a substantially downward-directed line section 145, which ends in a collecting cup 141" which has the ascending flow paths up to the overflow edges Ü.

As tests have shown, it is important to maintain a certain ratio $A_n/D_i$ in order to prevent the temperature stratification due to flowback of warmer water. In this context $A_n$ refers to the horizontal distance of the pressure vessel inside wall 1from the center line $M_{ü}$ which goes through the center of gravity of the cross section are $F_{ü}$ defined by the overflow edges Ü. $D_i$ means the inside diameter of the feedwater line 140 opening into the pressure vessel DE. The abovementioned ratio $A_n/D_i$ should be made as small as possible and is for this purpose approximately within the limits of 0.5 and 2.

Figure 2:
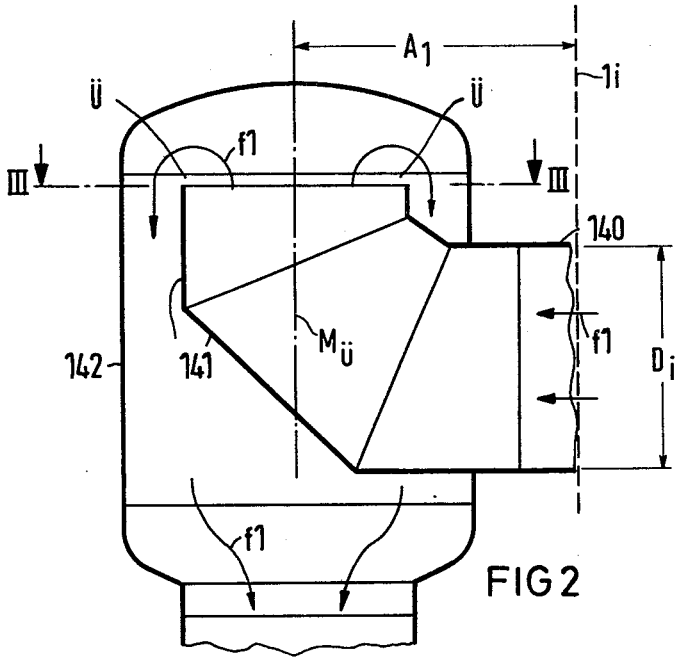
FIG. 2 is a fragmentary, enlarged view of the detail X from FIG. 1, being simplified.
Figure 3:
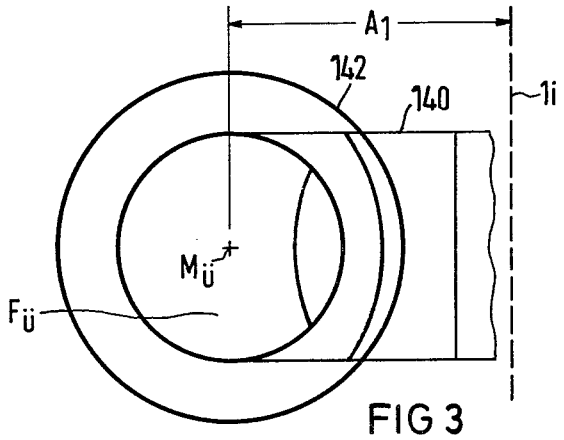
FIG. 3 is a fragmentary cross section according to line III-III from FIG. 2.

In FIGS. 2 and 3, the pressure vessel inside wall 1is shown in dashes and the center line $M_{ü}$ is drawn in a dot-dash line further, the dimension lines for the distance $A_n=A_l$ and the inside diameter $D_i$ are shown. From the table according to FIGS. 9, one obtains for the embodiment example according to FIGS. 2 and 3; $A_l=4.70$, $D_i=3.70$ and accordingly $A_n/D_i=1.27$.

Still more favorable values for the ratio $A_n/D_i$ are obtained for the embodiment examples according to FIGS. 4, 5 and FIGS. 6, 7. For a comparative consideration of FIGS. 4 and the table according to FIG. 9, a value $A_2=2.15$ is obtained, a value $D_i=3.55$ and accordingly, a ratio $A_n/D_i=0.61$. This favorable value results from the compact low design of the pipe line parts 141', 142. Correspondingly favorable values are obtained for the embodiment example according to FIGS. 6 and 7 with $A_3=1.50$, $D_i=2.50$ and $A_n/D_i=0.60$.

The embodiment example according to FIG. 8 shows in conjunction with FIG. 9 that there, the ratio $A_n/D_i$ moves in the range of the upper limit of FIG. 2. As an advantage of this example, the large passage cross section and the cylinder-symmetrical form should be mentioned, which is also present, by the way, in the embodiment example according to FIGS. 2 and 3. In general it can be said that cylinder-symmetrical shapes allow higher pressure stresses; box-shaped cross sections on the other hand have less pressure strength for a given wall thickness, but the dimension in the direction of $A_n$ is smaller. As a particularly advantageous design can therefore be considered the example according to FIGS. 1 to 3, where a relatively low ratio $A_n/D_i$ of 1.27 is realized and nevertheless, a relatively high pressure strength is provided with sufficient flow cross section. Compared therewith, the other embodiment examples can be considered as special designs in which either the ratio $A_n/D_i$ is held particularly low (FIGS. 4 to 7) or the flow cross section in the overflow region is particularly large (FIG. 8).

Overall, short flow paths to the overflow edges Ü can be arranged in relation to the line cross section, so that the feedwater has no opportunity to heat up appreciably on the path to the overflow edges. Heating up is counteracted by the mass flow of the feedwater which is characterized by the quantity $D_i$ which appears in the denominator of the ratio. The invention makes it possible in a relatively simple manner to keep the path and thereby, the dwelling time of the feedwater, with a mass throughput which is small relative to the flow cross section on the path of the feedwater to the overflow edges, so small that detrimental heating and thereby the consequent phenomenon of temperature stratification and circulating flow up to the feedwater nozzle are prevented.

In the table according to FIG. 9, the centimeter values are made the basis for $A_n$ and $D_i$ as they can be taken from an approximately-scale drawing. In order to obtain a concept of feasible scale dimensions, one should know that the pressure vessel of the steam generator according to FIG. 1 has an outside diameter of approximately 4800 mm in its separator region 1.4 (steam dome), so that for the quantities $A_l$ and $D_i$ shown in the enlargement according to FIGS. 2 and 3, values of approximately 500 mm and 400 mm, respectively, are obtained therefrom. The situation is then similar for the natural magnitudes of the $A_n$ and $D_i$ values of the other figures. The steam generator shown in FIG. 1 serves, for instance, together with three other steam generators in a 4-loop arrangement, for generating the operating steam in a 1200 $MW_{el}$ pressurized-water nuclear power station.

We claim:

1. Apparatus for preventing the formation of cracks in the inner surface of feedwater line nozzles which open into pressure vessels, the pressure vessels having a water/steam space and a descent space for medium formed therein, comprising a substantially horizontal line section connected to a pressure vessel for feeding feedwater into the water/steam space formed in the pressure vessel, a rising line section having a given flow travel length and being disposed downstream of said substantially horizontal line section, an overflow edge disposed at the end of said given flow travel length of said rising line section, and a downwardly-directed line section disposed at least partially between said overflow edge and the descent space formed in the pressure vessel for admixing feedwater with the medium in the water/steam space and in the descent space for preventing temperature stratification due to flowback to warmer water in the nozzle, wherein the ratio $A_n/D_i$ is substantially between 0.5 and 2.0, where $A_n$ is the distance along the horizontal from the inner surface of the wall of the pressure vessel to a centerline passing through the center of gravity of the cross-sectional area defined by said overflow edge; and $D_i$ is the inside diameter of said substantially horizontal line section connected to the pressure vessel.

2. Apparatus according to claim 1, wherein said ratio is between 0.6 and 1.5.

3. Apparatus according to claim 1, including a ring feed line connected to said downwardly-directed line section for conducting admixed feedwater and medium to said water/steam space and descent space.

4. Apparatus according to claim 1, wherein said rising line section includes a horizontal portion, a bend connected downstream of said horizontal portion, a substantially downwardly-directed portion connected downstream of said bend and a collecting cup disposed downstream of said substantially downwardly-directed portion defining rising flow paths, said overflow edge being integral with said collecting cup at an end of said flow paths.

* * * * *